US009665054B2

(12) United States Patent
Ishida

(10) Patent No.: US 9,665,054 B2
(45) Date of Patent: May 30, 2017

(54) IMAGE FORMING APPARATUS WITH TRANSPORT FOR MAGNETIC SHEETS

(71) Applicants: KABUSHIKI KAISHA TOSHIBA, Tokyo (JP); TOSHIBA TEC KABUSHIKI KAISHA, Tokyo (JP)

(72) Inventor: Kazufumi Ishida, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/732,541

(22) Filed: Jun. 5, 2015

(65) Prior Publication Data

US 2015/0360891 A1 Dec. 17, 2015

(30) Foreign Application Priority Data

Jun. 12, 2014 (JP) ..... 2014-121837

(51) Int. Cl.

| | |
|---|---|
| ***B65H 3/16*** | (2006.01) |
| ***G03G 15/00*** | (2006.01) |
| ***B65H 5/38*** | (2006.01) |
| *H01F 13/00* | (2006.01) |
| *G03G 15/20* | (2006.01) |

(52) U.S. Cl.

CPC ..... *G03G 15/6529* (2013.01); *B65H 5/38* (2013.01); *G03G 15/6591* (2013.01); *B65H 2401/113* (2013.01); *B65H 2401/114* (2013.01); *B65H 2401/115* (2013.01); *B65H 2401/213* (2013.01); *B65H 2404/6111* (2013.01); *B65H 2515/71* (2013.01); *B65H 2701/1714* (2013.01); *B65H 2701/1724* (2013.01); *G03G 15/2028* (2013.01); *G03G 15/657* (2013.01); *G03G 15/6558* (2013.01); *G03G 2215/00476* (2013.01); *H01F 13/00* (2013.01)

(58) Field of Classification Search

CPC .... B65H 2701/1714; B65H 2701/1724; B65H 2401/213; B65H 2515/71; B65H 2401/113; B65H 2401/114; G03G 15/2082; H01F 13/00

See application file for complete search history.

(56) References Cited

U.S. PATENT DOCUMENTS

| | | | | |
|---|---|---|---|---|
| 6,169,875 | B1 * | 1/2001 | Tidrick | B65H 5/38 399/400 |
| 7,707,758 | B2 * | 5/2010 | Stagg | B42D 15/006 229/92.8 |
| 2014/0227013 | A1 * | 8/2014 | Takahashi | G03G 15/2028 399/323 |

FOREIGN PATENT DOCUMENTS

| | | |
|---|---|---|
| JP | 2003-071978 | 3/2003 |
| JP | 2004-029095 | 1/2004 |

* cited by examiner

*Primary Examiner* — Howard Sanders

(74) *Attorney, Agent, or Firm* — Patterson & Sheridan, LLP

(57) ABSTRACT

A magnetic sheet transport apparatus according to an embodiment includes a transport path on which a magnetic sheet having a magnetic flux is transported. A magnetic member is disposed on the transport path. A separation unit is disposed on the magnetic member. The separation unit causes the magnetic sheet to be separated from the magnetic member so that the magnetic sheet being transported on the transport path is not pushed onto the magnetic member by the magnetic flux.

4 Claims, 4 Drawing Sheets

IMAGE FORMING APPARATUS WITH TRANSPORT FOR MAGNETIC SHEETS

CROSS-REFERENCE TO RELATED APPLICATION

This application is based upon and claims the benefit of priority from Japanese Patent Application No. 2014-121837, filed Jun. 12, 2014; the entire contents of which are incorporated herein by reference.

FIELD

Embodiments described herein relate generally to an image forming apparatus which may form an image on a magnetic sheet which may be subject to a magnetic force towards a magnetic surface.

BACKGROUND

In recent years, a magnetic sheet has been developed. The magnetic sheet may be subject to a magnetic force towards a magnetic surface. The magnetic sheet is formed by stacking a resin film on one face or both faces of the magnetic sheet. The resin film has magnetic properties. It is possible to form an image on the magnetic sheet using a printer or a copying machine.

When the image is formed on the magnetic sheet, it is necessary to transport the magnetic sheet along a transport path in the printer or the copying machine. At this time, the magnetic sheet may be pulled towards a transport guide of sheet metal, or the like, which has magnetic properties. Thus, a transport jam may occur.

Accordingly, an image forming apparatus which may reliably transport a magnetic sheet is needed.

DETAILED DESCRIPTION

A magnetic sheet transport apparatus according to an embodiment includes a transport path on which a magnetic sheet having a magnetic flux is transported. A magnetic member is disposed on the transport path. A separation unit is disposed on the magnetic member. The separation unit causes the magnetic sheet to be separated from the magnetic member so that the magnetic sheet being transported on the transport path is not pushed onto the magnetic member by the magnetic flux.

Hereinafter, an embodiment will be described in detail with reference to drawings. As used herein, "magnetic material" refers to a member of the class of materials that are subject to a magnetic force in the presence of a magnetic flux, for example, a ferromagnetic material.

Figure 1:
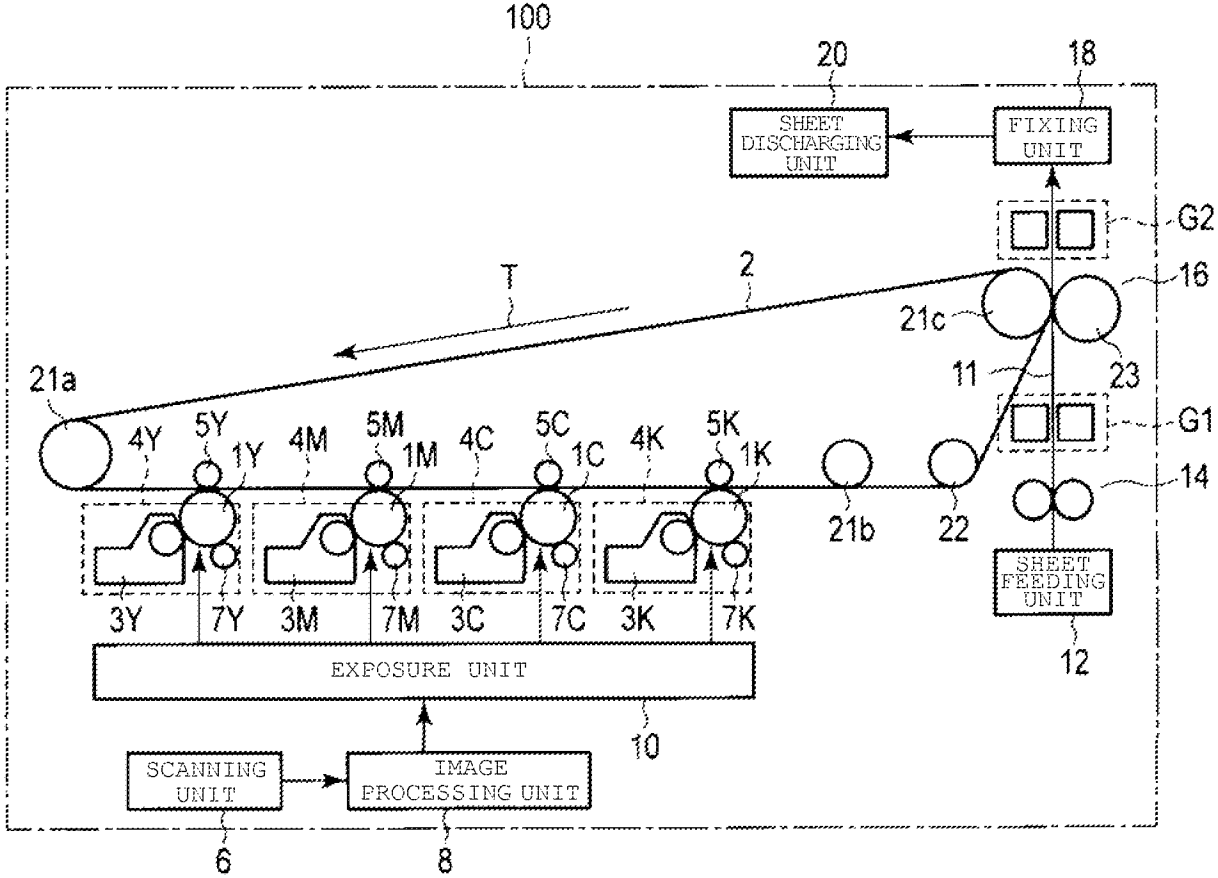
FIG. 1 is a schematic diagram illustrating an image forming apparatus according to an embodiment.
Figure 2:
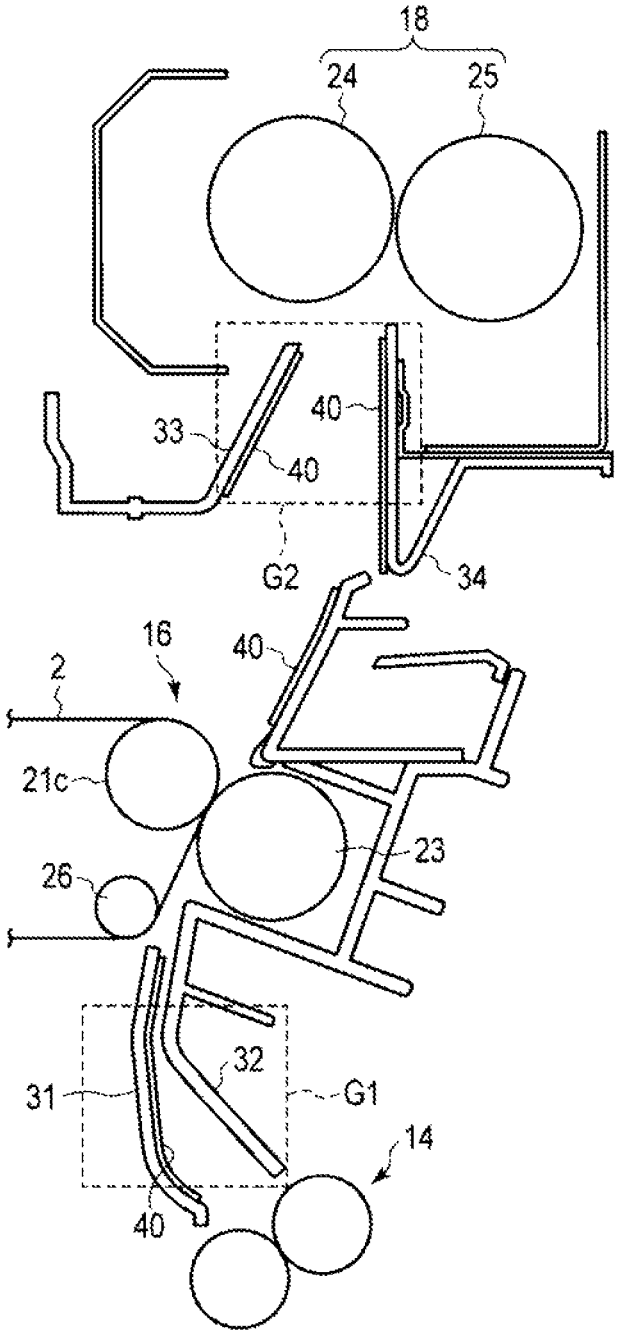
FIG. 2 illustrates a part of a transport path of the image forming apparatus.

FIG. 1 is a schematic diagram illustrating an image forming apparatus 100 (hereinafter, simply referred to as apparatus 100) according to the embodiment. FIG. 2 illustrates a part of a transport path of a magnetic sheet in the apparatus 100 in FIG. 1.

The apparatus 100 includes an endless intermediate transfer belt 2, a yellow image forming unit 4Y, a magenta image forming unit 4M, a cyan image forming unit 4C, a black image forming unit 4K, a scanning unit 6, an image processing unit 8, an exposure unit 10, a sheet feeding unit 12, a pair of resist rollers 14, a secondary transfer unit 16, a fixing unit 18, and a sheet discharging unit 20.

The intermediate transfer belt 2 is stretched over three belt rollers 21*a*, 21*b*, and 21*c*, and a tension roller 22 so as to run in an endless manner in an arrow T direction. The tension roller 22 applies a fixed tension to the intermediate transfer belt 2. A transfer roller 23 faces one belt roller 21*c* on the upper right side in the figure with the intermediate transfer belt 2 therebetween. The belt roller 21*c* and the transfer roller 23 are is included in the secondary transfer unit 16. The transfer roller 23 is disposed in contact with an outer face of the intermediate transfer belt 2. The transfer roller 23 according to the embodiment may be a foamed single-layered roller, having a center hardness of 35 degrees under conditions of a temperature at 23° C., and a humidity of 50%.

Image forming units 4Y, 4M, 4C, and 4K of each color respectively include a photosensitive drum 1, a developing unit 3, a transfer roller 5, and a cleaning roller 7. Since configurations of each of the image forming units are the same except for a difference in color of a developing agent, Y, M, C, and K are given to reference numerals of each configuration in FIG. 1. The image forming units 4Y, 4M, 4C, and 4K of each color are disposed with being separated from each other along the intermediate transfer belt 2 which runs between the belt rollers 21*a* and 21*b*.

The scanning unit 6 reads an image of the original document which is placed on a document table (not illustrated), and outputs image data to the image processing unit 8. The image processing unit 8 separates the image data which is input from the scanning unit 6 into each color component, and outputs the image data to the exposure unit 10. The exposure unit 10 forms electrostatic latent images by irradiating image carrying faces of photosensitive drums 1Y, 1M, 1C, and 1K of the image forming units 4Y, 4M, 4C, and 4K with laser light based on image data of each color. In addition, the electrostatic latent images are respectively developed using developing units of 3Y, 3M, 3C, and 3K of the image forming units 4Y, 4M, 4C, and 4K of each color. Developer images of each color are transferred (primary transfer) onto the outer face of the intermediate transfer belt 2 by being overlapped using transfer rollers 5Y, 5M, 5C, and 5K.

The developing unit 3 of each color supplies toner to the electrostatic latent image on the photosensitive drum 1 using a two-component developer which is a mixture of the toner and a magnetic carrier. The developer may be roughly classified as a two-component developer or a single-component developer. with the two-component developer (in which toner is non-magnetic), developing is performed by transporting toner to an electrostatic latent image due to magnetism of a carrier by applying a frictional electrification charge to the toner, using iron powder of which a particle diameter is several tens of or polymer ferrite particles as the carrier. With the single-component developer, the carrier is not used. The two-component developer is preferred in the embodiment.

Meanwhile, the sheet feeding unit 12 includes a plurality of sheet feeding cassettes (not illustrated), and a pickup roller (not illustrated) for taking out various recording mediums (such as sheets) on a transport path 11 from each of the sheet feeding cassettes. The sheet feeding unit 12 includes a manual sheet feeding unit (not illustrated), in addition to the sheet feeding cassette. The recording medium may be any suitable recording medium such as copy paper or a magnetic sheet.

Figure 3A:
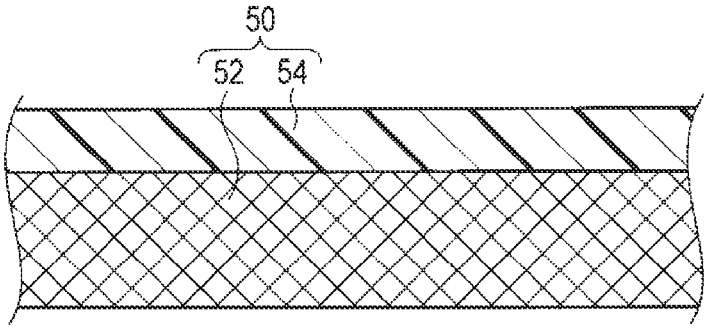
FIGS. 3A and 3B are enlarged cross-sectional views illustrating an example of a magnetic sheet which is used in the image forming apparatus.
Figure 3B:
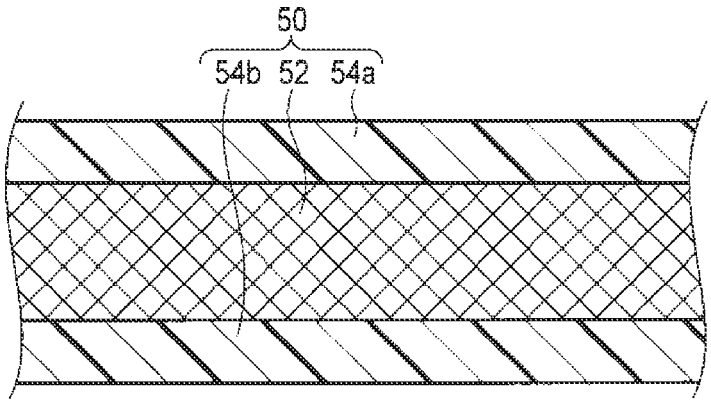

According to the embodiment, a case in which a magnetic sheet is the recording medium will be described. The magnetic sheet which is referred to here is made by laminating a printing sheet 54 (54*a* and 54*b*) with a thickness of 0.1 mm to 0.2 mm on a single face or both faces of a magnetic layer 52 with magnetism, as illustrated in FIGS. 3A and 3B as examples, respectively. An image is formed on the printing sheet 54 (54*a* and 54*b*). In a magnetic performance of a magnetic sheet 50, magnetic flux density is 4.1 mT to 8.5 mT. When assuming that the magnetic sheet 50 after printing will be used by being held to a magnetic substance such as a metal plate due to magnetism, it is necessary to set the magnetic flux density as 4 mT or more. In order to generate a magnetic force in which the magnetic sheet 50 which is held to a vertical face does not fall, it is preferable that the magnetic flux density be set as 8.3 mT or more.

The magnetic sheet supplied from the sheet feeding unit 12 is transported through a transport path 11, is temporarily stopped by being restricted by the pair of resist rollers 14, and is sent to the secondary transfer unit 16 at a transfer timing of a developer image which is transferred by being overlapped with the intermediate transfer belt 2 thereon. At this time, the magnetic sheet passes through a region G1 (indicated with an illustrated dashed line), and a transport thereof is guided.

In the secondary transfer unit 16, the transfer roller 23 rotates in contact with the transfer belt 2, and the magnetic sheet is received between the transfer roller and the transfer belt. At this time, the transfer roller 23 applies a high voltage bias to the magnetic sheet from the rear side of an image forming face, and a developer image on the intermediate transfer belt 2 is transferred to the front surface (image forming face) of the magnetic sheet (secondary transfer). In this manner, a transport of the magnetic sheet onto which developer images of each color are transferred is guided through a region G2 (indicated with an illustrated dashed line), and the magnetic sheet is sent to the fixing unit 18.

The fixing unit 18 includes a heat roller 24 which is in contact with the front surface of the transported magnetic sheet, and a pressure roller 25 which is in contact with the rear surface of the transported magnetic sheet, as illustrated in FIG. 2. The heat roller 24 heats and melts the developer image which is transferred onto the front surface of the magnetic sheet. The pressure roller 25 fixes the melted developer by pressing the developer to the magnetic sheet.

The magnetic sheet onto which the developer image is fixed by passing through the fixing unit 18 is discharged to a sheet discharging tray (not illustrated) of the discharging unit. In this manner, a color image is formed on the magnetic sheet. In addition, in the apparatus 100 according to the embodiment, forming of an image with respect to another recording medium such as copy paper is also possible.

As described above, when the magnetic sheet is transported through the transport path 11 in the apparatus 100, for example, the magnetic sheet may be subject to a magnetic force towards a magnetic member formed of sheet metal (such as a transport guide), and a transport error may occur. As illustrated in FIG. 2, according to the embodiment, at least transport guides 31, 33, and 34 which are disposed in the regions G1 and G2, the pair of resist rollers 14, and the belt roller 26 which winds around the intermediate transfer belt 2 are formed using a magnetic substance. Therefore, the magnetic sheet may be subject to a magnetic force towards the magnetic members 31, 33, 34, 14, and 26—which are disposed along the transport path 11.

Accordingly, the apparatus 100 according to the embodiment includes a separation unit which causes the magnetic sheet to be separated from the magnetic member up to a position at which the magnetic sheet is not significantly subject to a magnetic force towards the magnetic members 31, 33, 34, 14, and 26.

As an example of the separation unit, a non-magnetic member 40 is attached to the front surface of the respective transport guides 31, 33, and 34 on a side facing the magnetic sheet. The non-magnetic member 40 may be a non-magnetic sheet-like medium which is prepared in advance, and may be a member which is obtained by coating a non-magnetic material on the front surface of the transport guide. According to the embodiment, a non-magnetic sheet 40 with a thickness of approximately 1.5 mm is affixed to the front surface of the transport guides 31, 33, and 34.

The non-magnetic member 40 is formed using medium such as a polyester film or polyimide, general-purpose plastic such as ABS resin or polyethylene resin, or engineering plastic such as polyacetal resin.

Figure 4:
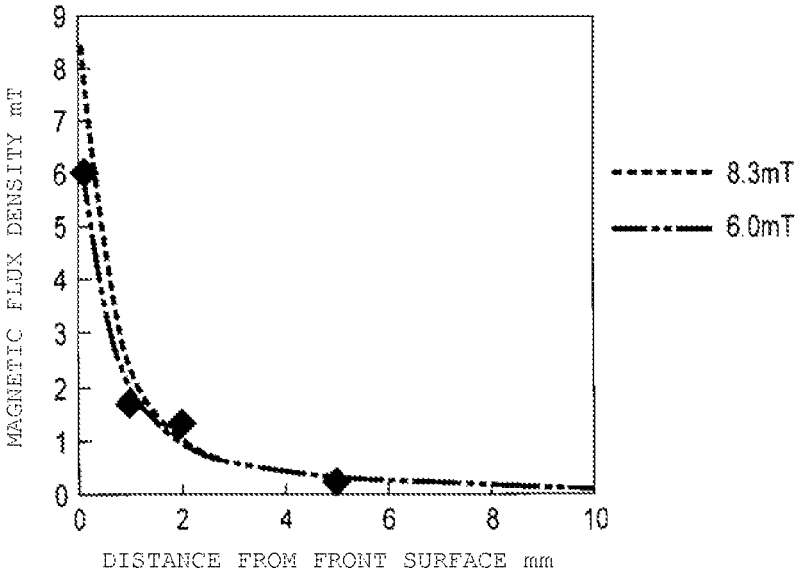
FIG. 4 is a graph illustrating a change in magnetic flux density which affects a magnetic member, as a function of distance between the magnetic member and the magnetic sheet on the transport path.

FIG. 4 is a graph illustrating a change in magnetic flux density which affects the magnetic member as a function of distance between the front surface of the magnetic member and the magnetic sheet. The magnetic member referred to herein is a member which is in a stationary state, such as a transport guide or the like, which is provided in a frame (not illustrated) of the apparatus 100 in a fixed manner. Since the magnetic sheet which is used in the embodiment has magnetic flux density of 4.1 mT to 8.5 mT, a change in magnetic flux density which affects the magnetic member is illustrated with respect to a magnetic sheet with magnetic flux density of 6.0 mT, and a magnetic sheet with magnetic flux density of 8.3 mT.

According to the graph of FIG. 4, it is understood that magnetic flux density which affects the magnetic member from the magnetic sheet is rapidly reduced as a distance between the magnetic member and the magnetic sheet increases. In particular, in the magnetic sheet which is used in the embodiment, when a distance between the magnetic sheet and the magnetic member exceeds approximately 1 mm, it is understood that magnetic flux density is sufficiently reduced so that the magnetic sheet is not significantly subject to a magnetic force towards the magnetic member. Accordingly, according to the embodiment, in order to provide at least a distance of approximately 1 mm between the front surface of the magnetic member and the magnetic sheet, the non-magnetic sheet 40 with a thickness of 1.5 mm is affixed to the front surface of the transport guide.

When also taking into consideration a result in FIG. 4, it is possible to prevent a transport failure due to magnetic force between all of magnetic members when it is possible to provide a distance of approximately 1 mm between each of magnetic members on the transport path, when the magnetic sheet which is used in the embodiment (magnetic flux density is 4.1 mT to 8.5 mT) is transported. All of magnetic members referred to herein include the pair of resist rollers 14 and the belt roller 26.

The separation unit which is provided on the front surface of the transport guides 31, 33, and 34 on the transport path 11 side may have any suitable configuration as long as it provides a distance of at least approximately 1 mm, physically, between the unit and the transported magnetic sheet. For example, as the separation unit, a rib (not illustrated) of which a protruding height from the front surface of the transport guide is approximately 1 mm may be provided. Also, as long as an area of a portion which is in contact with the magnetic sheet is sufficiently small, the separation unit may be formed using the magnetic member.

When the separation unit is provided on another magnetic member on the transport path—in the pair of resist rollers 14 or the belt roller 26, for example—a layer (not illustrated) using a non-magnetic material with a thickness of approximately 1 mm may be provided on the outermost surface of each roller. In addition, in this case, the possibility of causing a transport failure due to magnetic force becomes lower, since an area of the magnetic sheet which is in contact with the magnetic members 14 and 26 is small, as compared to a case in which the magnetic member is the transport guide, and the roller itself rotates in the transport direction of the magnetic sheet.

Figure 5:
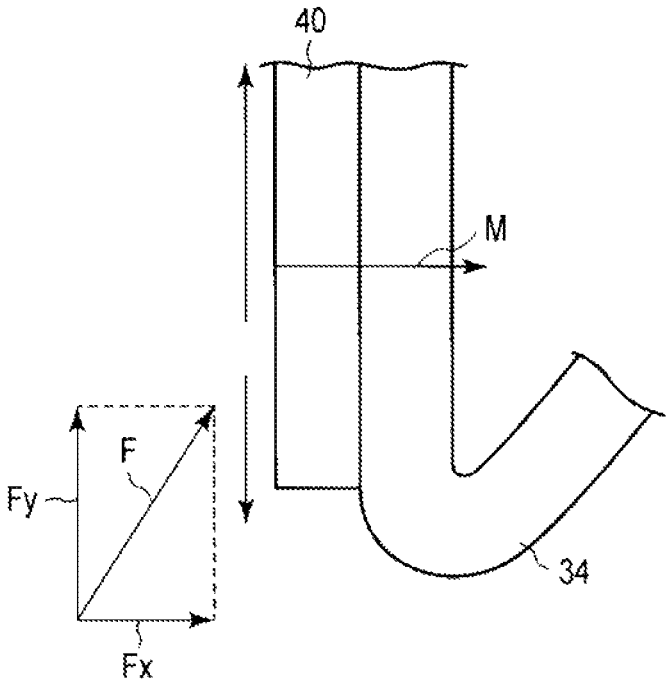
FIG. 5 is a diagram illustrating a force which affects the magnetic sheet as the magnetic sheet is transported along the magnetic member in FIG. 2.

FIG. 5 is a diagram illustrating the non-magnetic sheet 40 which adheres to the front surface of the transport guide 34 on the rear surface side (right side in figure) which is in the region G2 in FIG. 2. When considering conditions in which a magnetic sheet which being transported and is subject to a magnetic force towards the magnetic member, it is necessary to take into consideration gravity affecting the magnetic sheet, or a friction force which affects the magnetic sheet, as well, in addition to a magnitude of magnetic flux density from the magnetic sheet which affects the magnetic member, or a transport force of the magnetic sheet. Hereinafter, conditions in which the magnetic sheet is pushed towards the magnetic member due to magnetism when the magnetic sheet is transported along the magnetic member (transport guide 34) will be described in detail with reference to FIG. 5.

The magnetic sheet is transported in a direction (obliquely lower left side in figure) which is inclined to the front surface of the transport guide 34 on the transport path 11 side. The front surface of the transport guide 34 (facing the surface of non-magnetic sheet 40) extends in the vertical direction. At this time, when setting a transport force of the magnetic sheet as F, a component of the transport force F in the horizontal direction as Fx, a component of the transport force F in the vertical direction as Fy, a magnetic attracting force in the horizontal direction which affects the magnetic sheet as M, coefficient of dynamic friction between the magnetic sheet and the non-magnetic sheet 40 as μ, mass of the magnetic sheet as m, and acceleration of gravity as g, a friction force which affects the magnetic sheet from the non-magnetic sheet 40 is set as (Fx+M)μ. In this case, in order to make the magnetic sheet be transported without being adsorbed onto the transport guide 34 due to magnetism, it is necessary to satisfy the following expression (1).

$$Fy>(Fx+M)\mu+mg \quad (1)$$

That is, the thickness of the non-magnetic sheet 40 may be set so that the magnetic attracting force M which affects the magnetic sheet satisfies the above expression (1).

In contrast to this, conditions in which the magnetic sheet is easily pushed onto the magnetic member most are that an area of the magnetic sheet which is in contact with the magnetic member is large (that is, front surface of magnetic member is flat), and a state in which the magnetic member is stopped. Therefore, it is sufficient to set the thickness of the non-magnetic sheet 40 so as to have the magnetic attracting force M which satisfies the above expression (1) with respect to the magnetic member as well, which rotates like the pair of resist rollers 14 or the belt roller 26.

Even if it is a case in which magnetism affects the magnetic sheet from the pair of resist rollers 14 or the belt roller 26, since the magnetism is added to a transport force of the magnetic sheet, and it satisfies a relationship of transport force>friction force+gravity, there is no problem. Conversely, the front surface of the metallic transport guide in a standstill state is easily pushed to the magnetic sheet most due to magnetism, and accordingly, a distance of 1 mm or more on the front surface of the transport guide should be provided.

According to the image forming apparatus according to the embodiment, it is possible to reliably transport the magnetic sheet by including a separation unit which causes the magnetic sheet to be separated from the magnetic member up to a position at which the magnetic sheet is not pushed onto the magnetic member which is disposed along the transport path due to at least magnetism. In other words, according to the image forming apparatus according to the embodiment, it is possible to form an image by transporting the magnetic sheet in the apparatus without transport error. Therefore, it is possible to easily make the magnetic sheet on which a desired image is formed, and to improve convenience.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of transporting a magnetic sheet comprising the steps of:

transporting a magnetic sheet having a magnetic flux on a transport path though an image forming section in which an image is formed on the magnetic sheet, at least a portion of the transport path being formed of a magnetic member; and separating, with a separation unit disposed on the magnetic member, the magnetic sheet from a surface of the magnetic member so that the magnetic sheet being transported on the transport path is not pushed onto the magnetic member by the magnetic flux.

2. The method according to claim 1, wherein the separation unit includes a non-magnetic member that is provided on a transport path side with respect to the magnetic member.

3. The method according to claim 2, wherein the thickness of the non-magnetic member is between approximately 1 mm and 2 mm.

4. The method according to claim 1, wherein the separation unit is a rib extending from a surface of the magnetic member.

* * * * *